United States Patent [19]

Blaser et al.

[11] Patent Number: 4,587,010

[45] Date of Patent: May 6, 1986

[54] FLUID COKING WITH IMPROVED STRIPPING

[75] Inventors: Don E. Blaser, Randolph; Bong H. Chang, Summit; Charles L. Baker, Morris Plains, all of N.J.

[73] Assignee: Exxon Research and Engineering Co., Florham Park, N.J.

[21] Appl. No.: 743,917

[22] Filed: Jun. 12, 1985

Related U.S. Application Data

[63] Continuation-in-part of Ser. No. 596,098, Apr. 2, 1984, abandoned.

[51] Int. Cl.[4] ..... C10G 9/32

[52] U.S. Cl. ..... 208/127; 208/153; 422/144

[58] Field of Search ..... 208/127, 161, 153, 163, 208/168, 150

[56] References Cited

U.S. PATENT DOCUMENTS

| | | | |
|---|---|---|---|
| 2,420,632 | 5/1947 | Tyson | 208/153 |
| 2,422,262 | 6/1947 | Russel, 3d | 208/150 |
| 2,423,013 | 6/1947 | Evans | 208/168 |
| 2,439,348 | 4/1948 | Simpson et al. | 208/168 |
| 2,449,601 | 9/1948 | Gohr et al. | 208/150 |
| 2,488,493 | 11/1949 | Evans | 208/168 |
| 2,728,642 | 12/1955 | Cunningham et al. | 208/161 |
| 2,881,130 | 4/1959 | Pfeiffer et al. | 208/127 |
| 2,927,073 | 3/1960 | Moser, Jr. et al. | 208/127 |
| 2,948,670 | 8/1960 | Bray, Jr. et al. | 208/127 |
| 3,480,406 | 11/1969 | Luckenbach | 422/144 |

FOREIGN PATENT DOCUMENTS

| | | | |
|---|---|---|---|
| 0629178 | 10/1961 | Canada | 208/127 |

*Primary Examiner*—John Doll
*Assistant Examiner*—Anthony McFarlane
*Attorney, Agent, or Firm*—Marthe L. Gibbons

[57] ABSTRACT

A fluid coking process is provided in which the fluidizing and stripping gas is introduced as a plurality of streams in the proximity of flow deflecting means positioned in the stripping portion of the coking reactor such as to provide a specified superficial gas velocity in the stripping portion.

10 Claims, 4 Drawing Figures

FLUID COKING WITH IMPROVED STRIPPING

CROSS-REFERENCE TO RELATED APPLICATIONS

This application is a continuation-in-part of U.S. patent application Ser. No. 596,098 filed Apr. 2, 1984, now abandoned, the teachings of which are hereby incorporated by reference.

BACKGROUND OF THE INVENTION

1. Field of the Invention

The present invention relates to an improvement in a fluid coking process.

2. Description of the Prior Art

Fluid coking is a well-known process. See, for example, U.S. Pat. No. 2,881,130, the teachings of which are hereby incorporated by reference. Integrated fluid coking and coke gasification processes are also known and disclosed, for example, in U.S. Pat. Nos. 3,702,516; 3,759,676, and 4,325,815, the teachings of which are hereby incorporated by reference.

In the fluid coking process or in the integrated fluid coking and coke gasification processes, the solids present in the coking reactor have adherent hydrocarbons. The solids may be inert solids, catalytic solids and mixtures thereof. By the term "adherent hydrocarbons" is intended herein normally liquid hydrocarbons associated with the solid particles, in contrast to a carbonaceous deposit, such as coke, which is also present on the solid particles. The relatively cold solids (e.g., cold coke) stream which is removed from the coking reactor for reheating in a heating zone is usually stripped with steam in the lower portion of the coking reactor to remove at least a portion of the adherent hydrocarbons from the cold solids stream before the cold solids stream is passed to a heating zone. The steam is usually introduced into the bottom of the coking reactor. Nevertheless, the cold solids stream removed from the coking reactor still comprises a significant amount of adherent hydrocarbons. When a stream of cold solids having a carbonaceous deposit (e.g., coke) and adherent hydrocarbons is passed to a heating zone such as a burner, to heat the solids, the adherent hydrocarbons are burned and, hence, not recoverable as liquids. A method that would improve the stripping of hydrocarbons from the cold solids stream would, therfore, be desirable since it would enable recovery of the adherent hydrocarbons and, hence, increase the yield of normally liquid hydrocarbons obtainable from the fluid coking process. By "normally liquid", with reference to hydrocarbons, is intended herein hydrocarbons that would be liquid at standard conditions.

U.S. Pat. No. 2,927,073 discloses introducing a stripping gas into the stripping section of a coking reactor as a plurality of streams.

It has now been found that by introducing the stripping gas as a plurality of streams into the stripping portion of the coker to provide a specified superficial velocity in the stripping section, the removal of adherent hydrocarbons from the cold solids will be increased.

SUMMARY OF THE INVENTION

In accordance with the invention, there is provided, in a fluid coking process which comprises the steps of: (a) reacting a carbonaceous chargestock in a coking zone containing a bed of fluidized solids comprising at least about 75 weight percent particles greater than 100 microns in diameter, said solids being maintained under fluid coking conditions to form coke which deposits on said fluidized solids and a vapor phase product, including normally liquid hydrocarbons; (b) stripping said solids with the coke deposit and adherent hydrocarbons in the lower portion of said coking zone, by contacting said solids with a fluidizing and stripping gas to remove at least a portion of said adherent hydrocarbons from said solids, said lower stripping portion having positioned therein flow deflecting means spaced along the horizontal plane of said stripping portion; (c) removing a stream of the resulting stripped solids from said coking zone through a solids outlet means positioned in said coking zone; (d) passing the stream of removed solids to a heating zone to heat said solids; and (e) recycling a portion of said heated solids from said heating zone to said coking zone, the improvement which comprises introducing at least a portion of said fluidizing and stripping gas into said stripping portion as a plurality of streams along said horizontal plane in the proximity of said flow deflecting means such that the superficial gas velocity of said fluidizing gas through said stripping portion ranges from about 0.3 to about 1.0 foot per second.

DESCRIPTION OF THE PREFERRED EMBODIMENT

Figure 1:
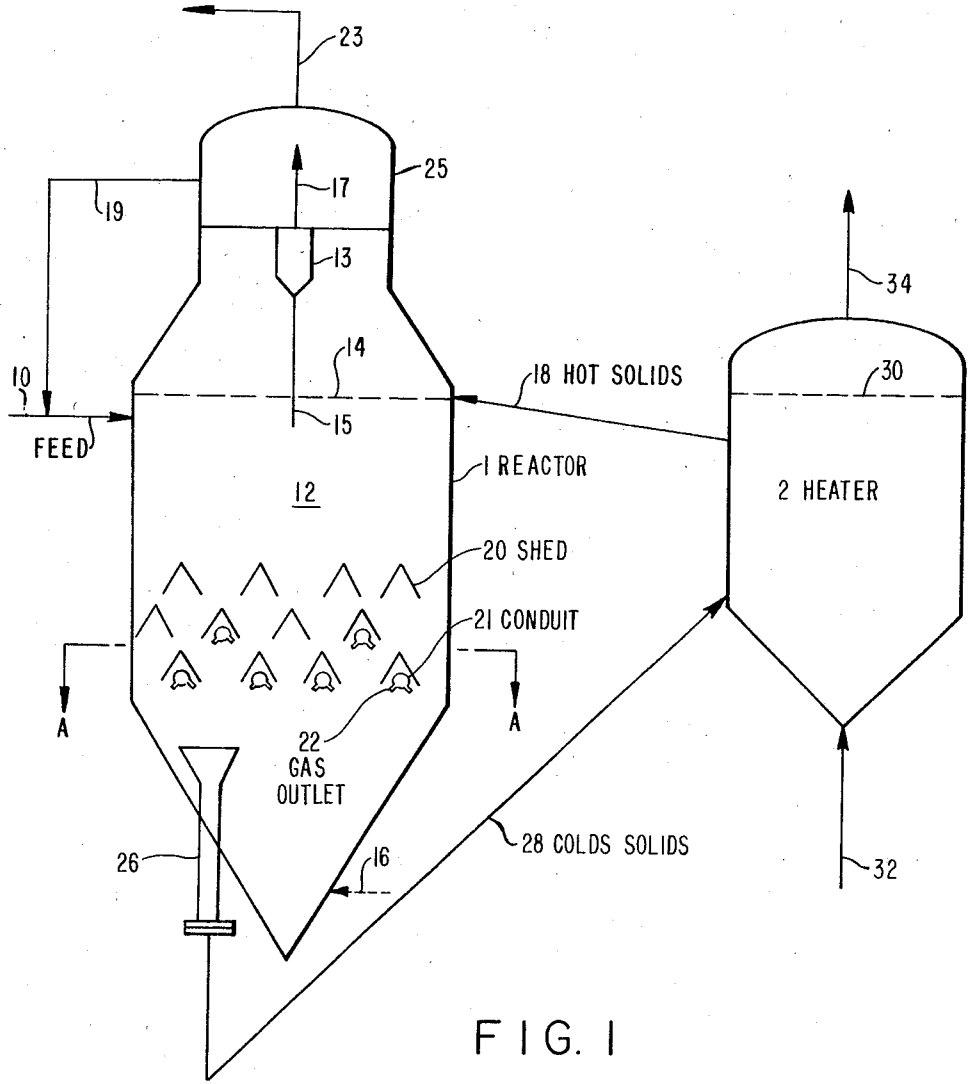
FIG. 1 is a schematic flow plan of one embodiment of the invention showing a vertical elevation section through the vessels.

Referring to FIG. 1, a carbonaceous chargestock is passed by line 10 into coking zone 12 in coking reactor 1 in which is maintained a fluidized bed of solids (e.g., coke particles of 40 to 1000 microns in size) having an upper level indicated at 14. At least about 75 weight percent of the solids in the fluidized bed of coking zone 12 have a particle size greater than 100 microns in diameter, and preferably at least about 35 weight percent of the solids have a particle size greater than 150 microns. A typical particle size distribution of fluid coke in a fluidized bed coking zone is shown in Table I.

TABLE I

| Microns | Wt. % |
|---|---|
| 20 | 0 |
| 40 | 0.8 |
| 60 | 3.5 |
| 80 | 5.8 |
| 100 | 20.0 |
| 150 | 64.0 |
| 300 | 92.0 |
| 400 | 95.0 |

Suitable carbonaceous chargestocks for introduction into the coking zone of the present invention include heavy hydrocarbonaceous oils; heavy and reduced petroleum crudes; petroleum atmospheric distillation bottoms; petroleum vacuum distillation bottoms; pitch; asphalt; bitumen; other heavy hydrocarbon residues; tarsand oils; shale oil; liquid products derived from coal liquefaction processes, including coal liquefaction bottoms and mixtures thereof. Typically, such feeds have a Conradson carbon residue of at least 5 weight percent, preferably above about 7 weight percent (as to Conradson carbon residue, test ASTM-D-189-65). A fluidizing and stripping gas is introduced into the reactor by line 12 as will be described later. Additional fluidizing gas may also be introduced by line 16 at the bottom of the reactor. The total amount of fluidizing gas and velocity through the coking zone must be at least sufficient to maintain the solids as a fluidized bed, that is, a superficial velocity of at least about 0.3. The superficial velocity is the velocity at which the gases and vapors would travel in the absence of solids in the coking reactor at reactor conditions. The fluidizing gas may comprise steam, gaseous hydrocarbons, normally liquid hydrocarbons, hydrogen, hydrogen sulfide and mixtures thereof. Typically, the fluidizing gas will comprise steam.

Figure 3:
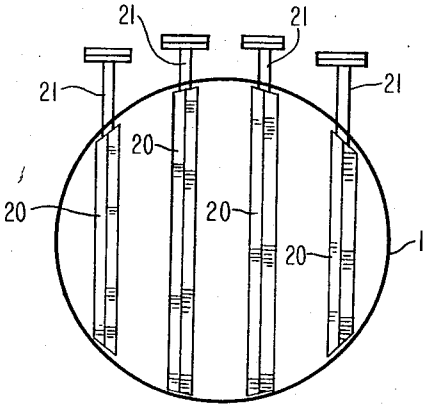
FIG. 3 is a plan view of section A—A of reactor 1.
Figure 2:
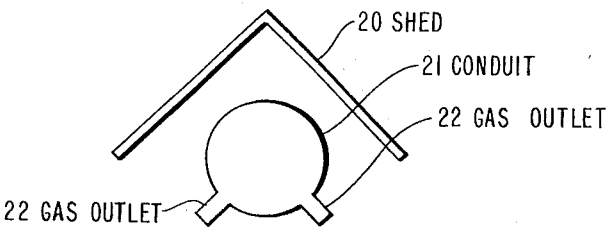
FIG. 2 is a detailed schematic vertical section through a shed.

Solids at a temperature above the coking zone temperature, for example, at a temperature from about 100 to about 900 Fahrenheit degrees above the actual operating temperature of the coking zone are admitted to coking reactor 1 by line 18 in an amount sufficient to maintain the coking zone temperature in the range of about 850° to about 1400° F., preferably from about 900° to about 1200° F. The pressure in the coking zone is maintained in the range of about 0 to about 150 pounds per square inch gauge (psig), preferably in the range of about 5 to about 100 psig. Conversion products are passed to cyclone 13 to remove entrained solids which are returned to coking zone 12 through dipleg 15. The vapors leave the cyclone through line 17 and pass into scrubbing zone 25 mounted on the coking reactor. If desired, a stream of heavy material condensed in the scrubbing zone may be recycled to the coking zone via line 19. The coking conversion products are removed from scrubbing zone 25 via line 23 for fractionation in a conventional manner. The lower portion of the coking reactor serves as a stripping section to remove at least a portion of the adherent hydrocarbons from the solids. Flow deflecting means are positioned in the stripping section of the coking zone. The flow deflecting means may suitably be sheds, baffles, disc-and donut, plates or any other flow deflecting device. In FIG. 1, three rows of sheds 20 are positioned across a horizontal plane of the reactor as well as along a vertical axis. Stripping gas conduits 21 are shown having stripping gas outlets 22. FIG. 2 shows the details of a vertical section through one of the shreds 20 and the location of a stripping gas conduit 21. FIG. 3 is a plan view of section A—A of reactor 1. It shows a plurality of stripping gas conduits 21 positioned below rows of sheds 20. In accordance with the present invention, the stripping gas, such as steam, will exit as a plurality of streams in the proximity of the flow deflecting means and in such a manner that the superficial gas velocity of the total fluidizing and stripping gas passing through the stripping section is maintained in the range from about 0.3 foot per second to about 1.0 foot per second, preferably from about 0.3 foot per second to about 0.9 foot per second, more preferably from about 0.6 foot per second to about 0.9 foot per second. By "proximity" is intended herein that the stripping gas streams may be ejected immediately below the flow deflecting means and/or within the region that contains the flow deflecting means. In FIG. 1, a number of stripping gas outlets 22 are shown immediately below sheds 20. The stripping gas stream outlets may be positioned along the circumference of the stripping section, as well as being staged along a vertical axis of the stripping section. A standpipe 26, having an upper open enlarged end, is positioned in the lower portion of coking reactor 1. Preferably, the stripping gas is introduced into the reactor in an area at least above the upper open enlarged end of standpipe 26. A portion of the stripped solids (cold solids) is removed from reactor 1 by standpipe 26 and passed by line 28 into a fluid bed of hot coke having a level 30 in heater 2. The heater may be operated as a conventional coke burner such as disclosed in U.S. Pat. No. 2,881,130, which is hereby incorporated by reference. When the heater is operated as a burner, an oxygen-containing gas, typically air, is introduced into heater 2 by line 32. The combustion of a portion of the solid carbonaceous deposition on the solids with the oxygen-containing gas provides the heat required to heat the colder particles. The temperature in the heating zone (burning zone) is maintained in the range of about 1200° to about 1700° F. Alternatively, heater 2 can be operated as a heat exchange zone such as disclosed in U.S. Pat. Nos. 3,661,543; 3,702,516 and 3,759,676, the teachings of which are hereby incorporated by reference. Hot solids are removed from the fluidized bed in heater 2 and recycled to the coking reactor by line 18 to supply heat thereto. A gaseous stream is removed from heater 2 by line 34.

While the process has been described for simplicity of description with respect to circulating coke as the fluidized solid, it is to be understood that the fluidized seed particles on which the coke is deposited may be silica, alumina, zirconia, magnesia, calcium oxide, Alundum, mullite, bauxite and the like. Furthermore, the circulating solids may comprise a catalyst. Preferably, the circulating solids are coke particles in the absence of a catalyst.

The following example is presented to illustrate the invention:

EXAMPLE

A fluid coking run, herein designated Run No. 1, was conducted utilizing the superficial stripping gas velocities in accordance with the present invention. The stripping gas conduits were positioned above the cold coke withdrawal standpipe. Two additional stripping gas conduits were positioned below a cold coke withdrawal standpipe. A fluid coking run, herein designated Run No. 2, was conducted at conventional stripping gas superficial velocities. In Run No. 2, all the fluidizing and stripping gas was introduced into the coking reactor below the upper entrance of the cold coke withdrawal standpipe. The fluidizing and stripping gas velocities through the stripping section in Run No. 1 and Run No. 2 are summarized in FIG. 4. The graph shows superficial gas velocity in feet per second versus relative height of the stripping section in feet. The conditions are summarized in the following table.

TABLE

Figure 4:
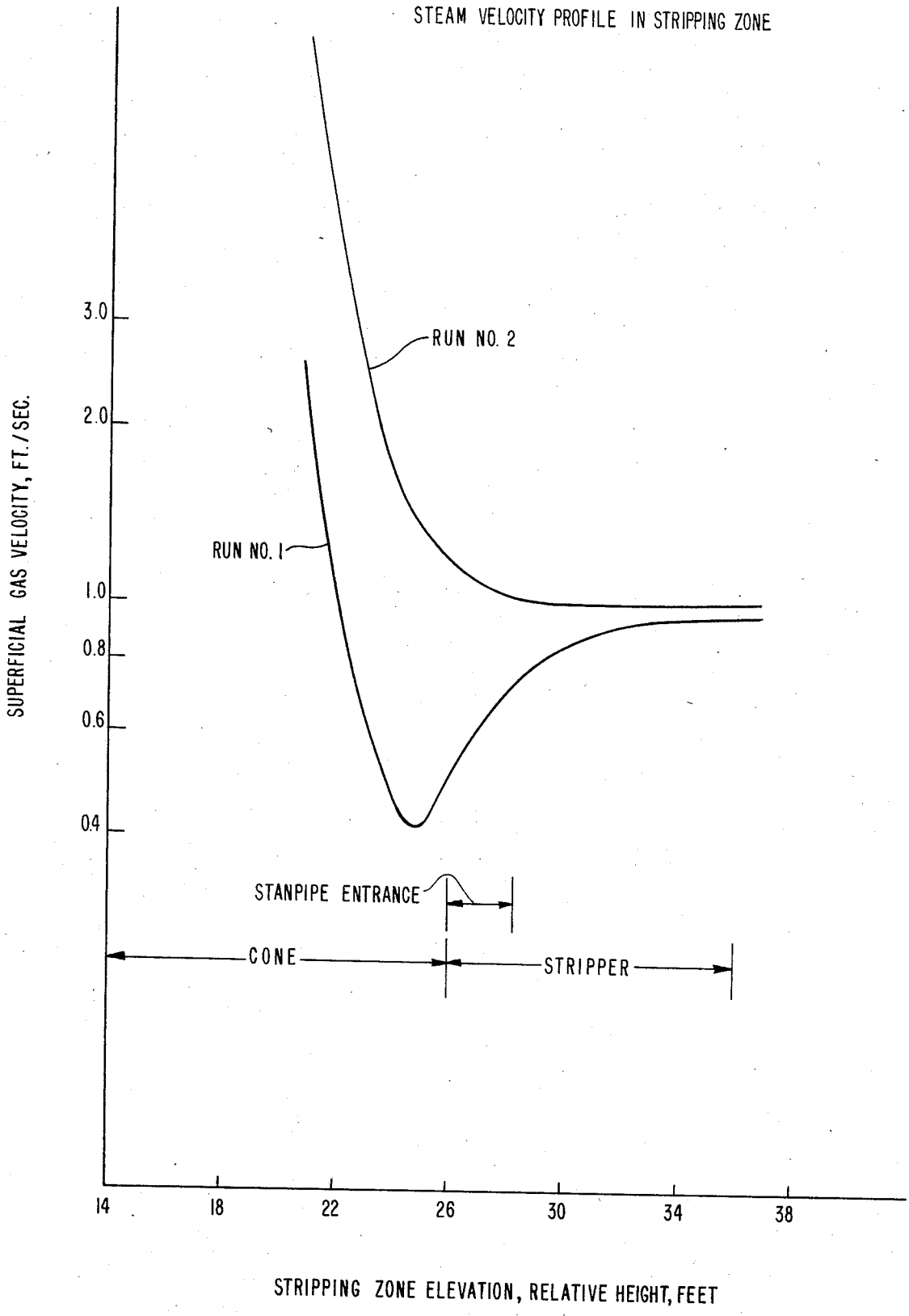
FIG. 4 is a graph showing stripping gas velocity versus relative height of the stripping zone.

| Conditions | Run No. 1 | Run No. 2 |
|---|---|---|
| Temperature, °F. | 966 | 966 |
| Pressure, psig | 55–60 | 55–60 |
| Total fluidizing and stripping gas | 90% base | base |
| Fluidizing gas velocity through stripping section | See Fig. 4 | |
| H/C(1) ratio of heater overhead flue gas, | 0.131 | 0.143 |

TABLE-continued

| Conditions | Run No. 1 | Run No. 2 |
|---|---|---|
| wt/wt | | |
| Adherent hydrocarbons on solids passed to heater, wt. % on fresh feed | (−2) | base |

(1)H/C denotes hydrogen to carbon ratio.

As can be seen from the above table, Run No. 1, which is in accordance with the present invention, utilized the same amount of total fluidizing gases as the comparative Run No. 2 and yet it enabled greater recovery of hydrocarbons, that is, less transference of hydrocarbons to the heater, than Run No. 2.

What is claimed is:

1. In a fluid coking process which comprises the steps of:

(a) reacting a carbonaceous chargestock having a Conradson carbon residue of at least 5 weight percent in a coking zone containing a bed of fluidized solids comprising at least about 75 weight percent particles greater than 100 microns in diameter, said solids being maintained under fluid coking conditions to form coke which deposits on said fluidized solids and a vapor phase product, including normally liquid hydrocarbons;

(b) stripping said solids with the coke deposit and adherent hydrocarbons in the lower portion of said coking zone, by contacting said solids with a fluidizing and stripping gas to remove at least a portion of said adherent hydrocarbons from said solids, said lower stripping portion having positioned therein flow deflecting means spaced along the horizontal plane of said stripping portion;

(c) removing a stream of the resulting stripped solids from said coking zone through a solids outlet means positioned in said coking zone;

(d) passing the stream of removed solids to a heating zone to heat said solids; and (e) recycling a portion of said heated solids from said heating zone to said coking zone, the improvement which comprises introducing at least a portion of said fluidizing and stripping gas into said stripping portion as a plurality of streams along said horizontal plane in the proximity of said flow deflecting means such that the superficial gas velocity of said fluidizing gas through said stripping portion ranges from about 0.3 to about 1.0 foot per second.

2. The process of claim 1 wherein said fluidizing and stripping gas has a superficial gas velocity ranging from about 0.3 to about 0.9 foot per second.

3. The process of claim 1 wherein said fluidizing and stripping gas is introduced into said stripping section above said solids outlet means.

4. The process of claim 1 wherein said fluidizing and stripping gas is introduced into said stripping portion below said flow deflecting means.

5. The process of claim 1 wherein said flow deflecting means comprises a plurality of sheds spaced along the horizontal plane of said stripping portion.

6. The process of claim 5 wherein said flow deflecting means are staged along the vertical plane of said stripping portion and wherein said fluidizing and stripping gas is introduced into said stripping portion as a plurality of vertically staged streams.

7. The process of claim 5 or 4 wherein said fluidizing and stripping gas is introduced as a plurality of streams positioned in the circumference of said stripping portion.

8. The process of claim 1 wherein said coking conditions include a temperature ranging from about 850° F. to about 1400° F.

9. The process of claim 1 wherein said coking conditions include a temperature ranging from about 900° F. to about 1200° F.

10. The process of claim 1 wherein said fluidized solids of step (a) are coke particles and wherein said coke particles comprise at least about 35 weight percent particles having a size greater than 150 microns in diameter.

* * * * *